United States Patent [19]

Lindow et al.

[11] Patent Number: 4,969,833

[45] Date of Patent: Nov. 13, 1990

[54] PERMANENTLY ATTACHABLE KEY-ACTIVATED ON/OFF SWITCH

[76] Inventors: Edgar J. Lindow; Denise L. Domning, both of 1832 Brookshire, Tustin, Calif. 92680

[21] Appl. No.: 253,086

[22] Filed: Oct. 4, 1988

[51] Int. Cl.[5] ..... H01R 13/44; H01R 13/625

[52] U.S. Cl. ..... 439/133; 200/43.05; 200/43.11; 200/51.12; 439/346

[58] Field of Search .... 200/43.01, 43.05, 43.11–43.13, 200/43.22, 51.11; 439/133, 134, 304, 346, 366

[56] References Cited

U.S. PATENT DOCUMENTS

| | | | |
|---|---|---|---|
| 3,345,603 | 10/1967 | Cohen | 339/176 |
| 3,543,218 | 11/1970 | Archer | 439/346 |
| 4,080,029 | 3/1978 | St. Fort | 339/34 |
| 4,085,991 | 4/1978 | Marshall et al. | 439/346 |
| 4,136,919 | 1/1979 | Howard et al. | 439/346 |
| 4,167,658 | 9/1979 | Sherman | 439/346 |
| 4,445,738 | 5/1984 | Wiencke | 339/37 |
| 4,479,688 | 10/1984 | Jennings | 339/37 |
| 4,579,410 | 4/1986 | Soloman | 439/133 |

OTHER PUBLICATIONS

Dillingham, Susan "Business Briefing: Putting Power Under Lock and Key", Insight, Aug. 29, 1988.

*Primary Examiner*—Paul A. Bradley

*Attorney, Agent, or Firm*—Knobbe, Martens, Olson & Bear

[57] ABSTRACT

A permanently attachable key-activated on-off switch comprises a housing with an electrical receptacle on one end and an electrical plug on the other. The electrical receptacle receives a locking pin that is inserted through the prongs of the receptacle and an appliance plug in the receptacle so that the appliance plug is permanently attached. A key switch is attached to the housing which controls and the flow of power between the electrical plug and the electrical receptacle when the electrical plug is inserted into a standard electrical outlet.

12 Claims, 4 Drawing Sheets

FIG. 2
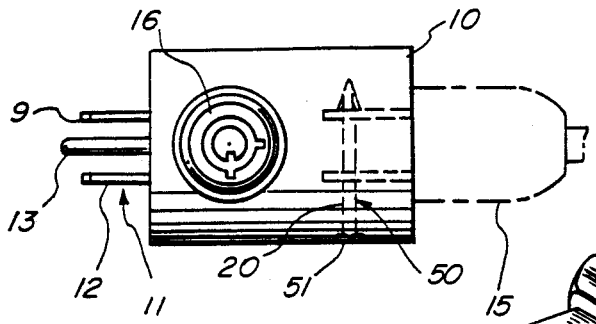
FIG. 1
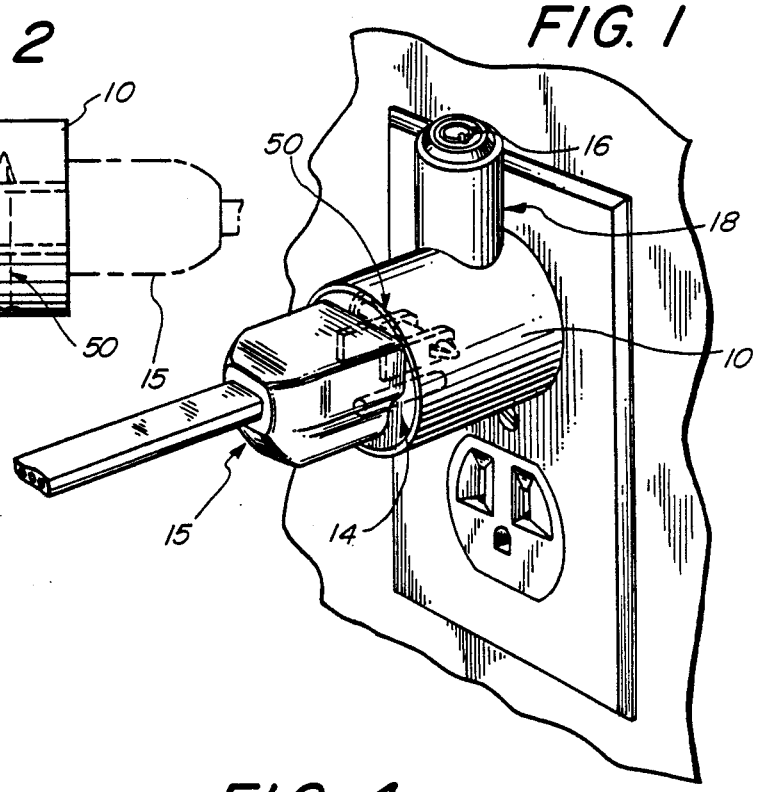
FIG. 3
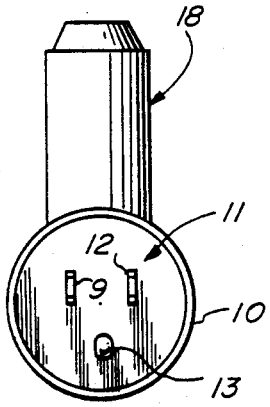
FIG. 4
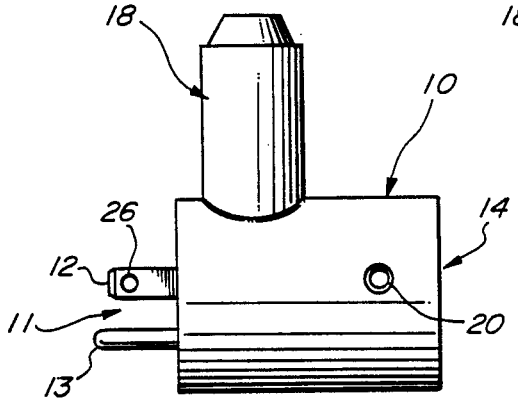
FIG. 5
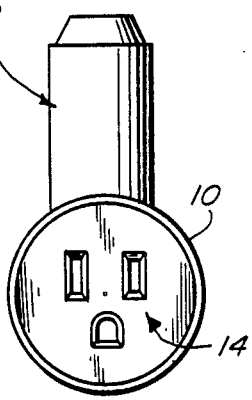
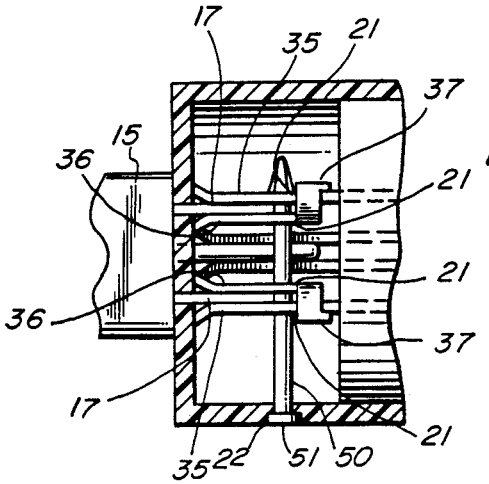
FIG. 6

FIG. 15
FIG. 14
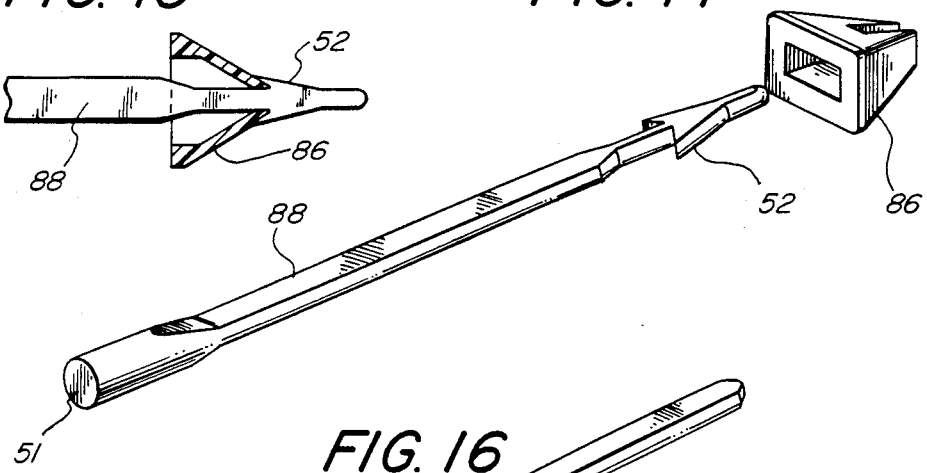
FIG. 16
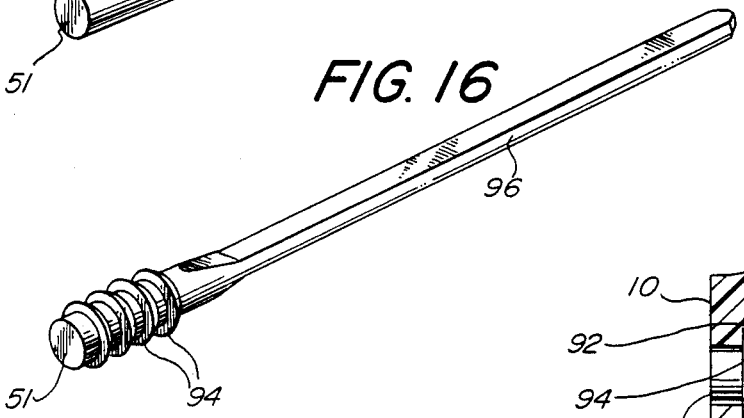
FIG. 17
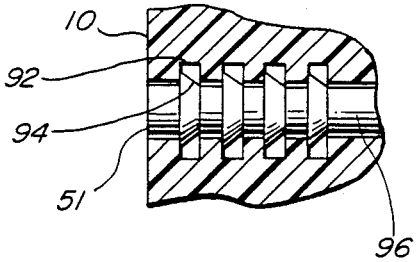
FIG. 18
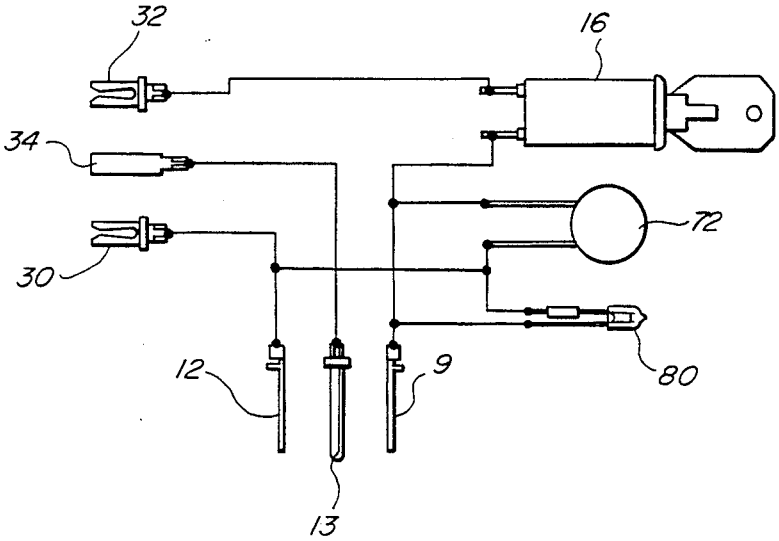

PERMANENTLY ATTACHABLE KEY-ACTIVATED ON/OFF SWITCH

BACKGROUND OF THE INVENTION

This invention is a device that permanently attaches to the electrical plug of an appliance and requires a key in order to permit power to be delivered to the appliance. Such a device restricts operation of an electrical appliance so that only authorized persons with a key may allow the appliance to be used. A typical home use of the device would be to attach it to a television so that a parent with a key to the switch can regulate when the television may be operated by the children.

However, the present invention may also be employed in the workplace where access to certain electrical appliances needs to be restricted. The unauthorized use of photocopiers outside of business hours may be prevented by opening the key activated switch and removing the key. Similarly, the use of computer time, which may be very expensive, can be regulated by employing the present invention if the computer is permanently attached to its power supply line. While passwords in a computer system present a hurdle to the unauthorized access of data, the present invention prevents the exposure of the password to potential violators.

Many devices for locking electrical plugs exist in the prior art. Some of these devices lock electrical plugs into electrical receptacles. U.S. Pat. No. 4,479,688 to Jennings discloses a wall outlet lock device. The device has a cover that locks over a plug that is plugged into the wall outlet device. One lock secures the cover to the apparatus so that the plug cannot be removed. A key-operated switch controls the flow of power to the device so that use of the device plugged in can be regulated. One feature of this device is that it locks the plug to the wall so that the appliance cannot be removed. In this way, the device prevents theft. However, because of the potential fire hazard, universal housing codes presently restrict the locking of electrical devices into wall outlets.

This device has another major disadvantage. Because the device is attached to the wall outlet, the device cannot be transported with the appliance while the plug is locked in. Thus, one cannot move the appliance to be locked without installing another device at another location. For example, if a parent wished to limit the use of a portable stereo by children, the parent can only regulate the use of the portable stereo only if it remains in the one location where the device has been installed. The parent can move the portable stereo to another location and still restrict its use only if the parent has another device installed This can be a real problem, especially if the appliance is one that is moved often.

U.S. Pat. No. 4,080,029 to St. Fort discloses a plug lock device. The device locks a plug into a wall outlet and requires a key to release the plug from the outlet. The device prevents anyone without a key from removing the plug from the outlet and thus can prevent theft. However, the device has no means for regulating the flow of power to the appliance. Thus, the device cannot be used to prevent unregulated use.

U.S. Pat. No. 3,345,603 to Cohen discloses an electrical plug key lock device similar in operation to the St. Fort device. The device allows the plug to be locked into a wall outlet. The plug can only be removed by unlocking it with a key. The device, however, is only capable of preventing accidental and intentional removal of an appliance plug from a receptacle. Consequently, the device does not provide any means for regulation of the flow of power to the appliance so it can not be used to restrict use of an appliance.

Although there are many plug lock devices in the prior art, none satisfy the need for the regulation of power supplied to an appliance by a device that permanently attaches to the appliance and not to the wall. In addition, a further serious disadvantage of the prior art is that many devices in the art violate housing and building codes because the devices permanently attach to wall outlets. There is a great need for a device that attaches to an appliance and allows the use of the appliance to be regulated.

SUMMARY OF THE INVENTION

The present invention is a permanently attachable key-activated on/off switch It receives and locks with an electrical plug of an appliance at one end. At the other end is a plug which may be received into a standard wall outlet. The flow of power to the attached appliance is regulated by a key switch. The invention may be easily plugged into or removed from a wall outlet. The invention is, however, permanently attachable to the plug of the appliance. Thus, the appliance can be moved to another wall outlet and still be regulated by the key switch of the device. The present invention allows an appliance with the present invention permanently attached to be received into any receptacle at any time.

All Underwriters' Laboratory (U.L.) approved 120 volt 15 amp standard two and three prong power plugs must have a hole, approximately 0.125 inches in diameter drilled through both power prongs of the plug. All U.L. approved electrical receptacles have dimples in the power prongs that rest inside the holes of the power prongs of an electrical plug that is inserted into the receptacle. This helps hold the electrical plug inside the receptacle.

In one embodiment of this invention, a standard electrical receptacle is modified by drilling holes in the prongs where the dimples are in a standard receptacle. Once a power plug is inserted into the modified electrical receptacle of the invention, the holes in the plug will coincide with the holes drilled in both the receptacle power prongs and the power plug housing. The appliance plug is permanently attached to the invention by inserting the unremovable plastic locking pin through the housing, the modified receptacle and the plug. Once the plastic barbs at the tip of the plastic pin pass through all of the holes and expand, the plastic pin cannot be withdrawn. The plug of the appliance is then permanently attached to the key-activated on/off switch.

A second embodiment of the present invention also offers the advantages of permanently attaching to the appliance, rather than the wall, permitting mobility of the appliance subject to the invention and permitting key regulated access to the appliance's functions. This further embodiment incorporates a surge protector and power indicator. This second embodiment has the additional advantage of not requiring modification of a standard U.L receptacle. The second embodiment further provides for alternative means for locking the appliance to the present invention.

The present invention offers the advantages of providing a means of regulating the power supply to a given appliance without violating universal housing codes. In addition, the present invention provides for the permanent attachment of a power regulating means without inhibiting the mobility of the appliance. The universal applicability of the invention to any U.L. approved electrical appliance allows the invention to be employed for home, office and industrial uses. Also, the key operation of the power regulating means provides for strictly controlled, tamperproof access to the appliance.

It is an object of this invention to provide a permanently attachable key-activated switch that prevents unauthorized use of an appliance attached to the switch by requiring a key to activate a switch that allows power to flow to the appliance. A typical home use of this invention is for parents to limit the use of an entertainment appliance, such as a television set by permanently attaching the present invention to the television power prongs. In addition, the present invention may be permanently attached to power tools so as to prevent unauthorized use.

It is a further object of this invention to provide a permanently attachable key-activated switch that locks permanently with a standard electrical plug of an appliance that is desired to be regulated. Because the device locks with the plug of the appliance, rather than locking the plug to a wall outlet, the appliance can be moved with the device attached. This is especially useful if the appliance is used in different electrical outlets at different locations.

It is a further object of this invention to provide a permanently attachable key-activated switch that is simple and easy to install and to use. The only step necessary for installation is to insert the plastic locking pin in the hole in the device and the plug of the appliance. The switch is a simple key-activated on/off switch.

It is a further object of this invention to provide a permanently attachable key-activated switch that is simple and easy to construct.

BRIEF DESCRIPTION OF THE DRAWINGS

FIG. 1 is a perspective of the first embodiment of a permanently attachable key activated on-off switch.

FIG. 2 is a top plan view of the first embodiment.

FIG. 3 is a front elevation of the first embodiment.

FIG. 4 is a side elevation of the first embodiment.

FIG. 5 is an end elevation of the first embodiment.

FIG. 6 is a cut-away top plan of the first embodiment.

FIG. 14 is a perspective of the barbed locking pin and retainer.

FIGS. 15 is an overhead cross section of the barbed locking pin engaging the retainer.

FIG. 16 is a perspective of the straight locking pin.

FIG. 17 is a cut-away of the straight locking pin received in the housing.

FIG. 18 is a schematic of the electrical circuit of the second embodiment.

DESCRIPTION OF THE PREFERRED EMBODIMENT

Figure 7:
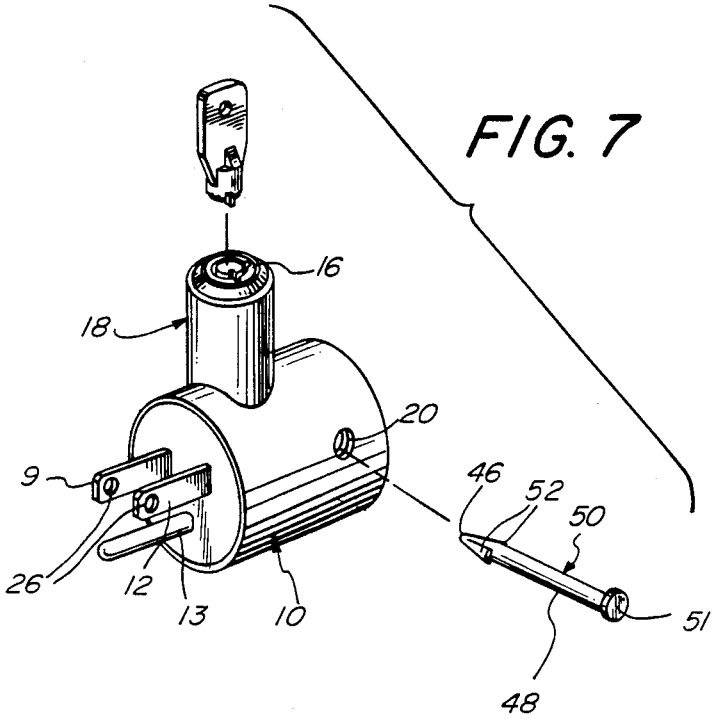
FIG. 7 is an exploded perspective of the first embodiment.

FIG. 1 shows the first embodiment of a permanently attachable key-activated on/off switch. Referring to FIG. 2, the front end of the device consists of a standard electrical plug configuration The standard electrical plug 11 comprises two power prongs 12 and one ground prong 13. The electrical plug is on the front face of the cylindrical housing 10 that forms the base of the invention. The rear face of the cylindrical housing 10 contains an electrical receptacle 14 (shown in FIG. 5) which can connect with any standard size electrical plug 15. A hole 20 is provided in the housing 10 to allow a plastic locking pin 50, shown in FIG. 2, to be inserted through the housing wall and through the electrical receptacle 14. As shown in FIGS. 1 and 2, when a standard electrical plug 15 of an appliance is plugged into the receptacle end 14 of the invention, a plastic locking pin 50 may be inserted into hole 20 through the receptacle and through the holes that are in each of the two prongs 12 of the standard electrical plug 15. In this way, the standard electrical plug of the appliance may be permanently attached to the invention.

As shown in FIGS. 1, 3, 4, 5 and 7, a switch housing 18 is cylindrical and attaches to the plug housing 10. The switch housing 18 contains a key operated single pole, single throw electrical on/off switch The switch inside the switch housing lB is switched on and off through means of the key operated device 16.

Figure 8:
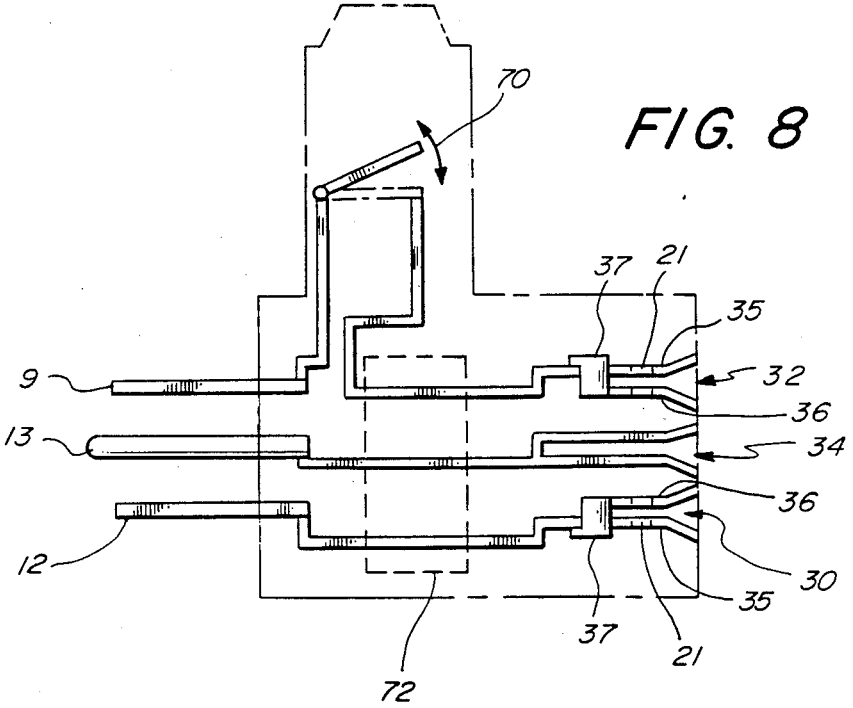
FIG. 8 is a schematic of the first embodiment's electrical configuration.

Referring to FIGS. 6 and 8, the electrical receptacle 14 is shown including its two modifications from standard electrical receptacles. Except for these modifications, which are described below, the electrical receptacle is identical to a standard U.L. approved receptacle. The second embodiment, described below, employs a receptacle that requires no modifying. The receptacle contains two power receptacles 30 and 32 and one ground prong 34. These prongs are all spaced apart by dimensions identical to standard U.L. approved electrical receptacles. The receptacle is surrounded by the housing 10. Each of the power receptacles 30 and 32 are comprised of a main electrical prong 35 and a secondary electrical prong 36 with spring clip 37. The secondary electrical prong 36 with spring clip 37 may be a subassembled part. The spring clip 37 of the secondary electrical prong 36 may be attached to the main electrical prong by means known in the art, such as a spot weld. Preferably, all prong material is copper flat stock, as known in the art.

There are two slight differences between the special electrical receptacle 14 of this invention and a standard electrical receptacle. The first difference is that the main prongs 35 and the secondary prongs 36 are slightly wider. In a standard electrical receptacle, both the main and secondary electrical prongs are approximately 0.20 inches. In the special electrical receptacle 14 of this invention, both the main electrical prongs 35 and the secondary electrical prongs 36 are 0.30 inches wide.

As shown in FIG. 6, the second difference between the electrical receptacle 14 and standard electrical receptacles is that both the main electrical prongs 35 and the secondary prongs 36 have a 0.125 inch diameter hole 21 drilled through them. As shown in FIGS. 6 and 8, the hole 21 is drilled through four prongs, one through each of the two main prongs 35 and the two secondary prongs 36

The above dimensions are preferred. Other dimensions may be used which still embody the invention.

Referring to FIG. 6, the holes 21 in both the main electrical prongs 35 and the secondary electrical prongs 36 are aligned with the hole 20 drilled through the main housing 10, which is in turn aligned with the holes in the prongs 17 of standard electrical plugs 15. These holes are standard U.L. approved holes and are similar to the hole 26 in the prongs 12 of the present invention, as shown in FIGS. 4 and 7. These holes are aligned such that a plastic locking pin 50 can pass through all of the holes 21 in the prongs of the electrical receptacle. A counter-sunk hole 22 is drilled into the housing, surrounding hole 20 to allow the head 51 of the plastic locking pin 50, shown in FIG. 3, to sit recessed into the housing 10 of the invention so that it is flush with the outside surface of the housing 10.

FIG. 7 discloses a structure of the plastic locking pin 50 in detail. The shaft 48 of the locking pin is 0.10 inches in diameter The length of the pin from the head 51 to the sharpened point 46 is 1.375 inches. These dimensions are preferred, but other dimensions may be used which embody the present invention. Attached to the tip of the head are two plastic barbs 52. These plastic barbs 52 will collapse sufficiently to allow passage of the pin 50 through the hole 20 in the outside housing 10, the holes 21 in the electrical prongs 35, 36 of the receptacle 14, and the prongs 17 of a standard electrical plug 15 from the appliance desired to be regulated by this invention. Once the plastic barbs 52 pass through the last hole 21 in the far electrical prong 35 of the receptacle 14, as shown in FIG. 6, the barbs 52 will expand away from the shaft sufficiently to prevent the pin's removal from the holes.

As shown in FIGS. 1 and 6, when the locking pin is permanently in place, a standard electrical plug is locked into the invention. When the plastic pin 50 is fully inserted into the invention, the head 51 of the plastic pin 50 sits in the countersunk hole 22 in the outer casing of the invention. This prevents anyone from being able to apply a pulling force on the pin in an attempt to remove it from the invention.

In FIGS. 1 and 6, the plastic barbs 52 of the pin are extended, thus preventing withdrawal of the pin from the invention. The pin passes through the hole 20 in the outer casing, through the holes 21 in the prongs 30 and 32 of the receptacle 14, and through the holes of the prongs 60 of the appliance desired to be regulated. With the pin locked in the holes in the prongs of the receptacle and the holes in the prongs of the plug inserted into the invention, the plug of the appliance inserted into the invention is permanently attached to the invention so that it cannot be removed. A significant feature of this invention is that the lock attaches to the appliance so that the appliance can be moved with the device attached.

FIG. 8 illustrates the wiring of the invention All of the electrical connections are made with number 14 A.W.G. wire, which is rated for 120 volts and 15 amps. The ground receptacle 34 of the receptacle 14 is connected to the ground prong 13 of the plug of the invention. The power receptacle 30 of the receptacle 14 is connected to the prong 12 of the plug of the invention. The power receptacle 32 of the receptacle 14 is connected to a switch 70 which is located in the switch housing 18. The other side of switch 70 is wired to prong 9 of the plug of the invention.

The switch 70 is mounted in the switch housing 18. The switch 70 is a single pole, single throw switch. When the switch is in the open position, there is no connection between the prong 32 of the receptacle 14 of the invention and prong 9 of the plug of the invention. When the plug of an appliance is locked into the receptacle 14 with the plastic locking pin 50, there will be no current flow to the appliance when the switch is open. When the switch is in the closed position, the prong 9 of the plug of the invention and the prong 32 of the receptacle 14 of the 15 invention are connected electrically, allowing current to flow between them. In the closed position, the switch allows current to flow to the appliance that has its plug locked into the invention with the plastic locking pin. Since the switch controls the flow of current to the appliance that is locked into the invention, the switch controls whether or not the appliance can be operated. Because it is an object of this invention to limit the use of any appliance locked into the invention to authorized persons only, the switch 70 in the invention is activated by a key lock 16. This key switch is known in the art, and whose purpose is served by Radio Shack key switch part no. 49-515. In this way, operation of the switch is limited to authorized persons with a key only. Thus, only authorized people will be able to operate the switch and be able to allow use of the appliance that has its plug permanently attached to the invention.

FIG. 8 also illustrates an optional wiring diagram of the invention which includes an electrical surge protection circuit [shown in phantom], which may be a Radio Shack surge protector part no. 276-568. The function of the surge protection circuit is to protect the attached electrical appliance from transient irregularities in voltage and amperage, commonly referred to as spikes The surge protection circuit prevents these potentially damaging voltage irregularities from reaching the attached appliance by diverting them away from the appliance and to ground through the ground plug 13.

The second embodiment of the present invention is shown in FIGS. 9–18. In the second embodiment, there is no modification of a standard U.L. approved receptacle necessary. The electrical receptacle 14 is dimensioned to meet standard U.L. approved electrical receptacle standards.

Figure 9:
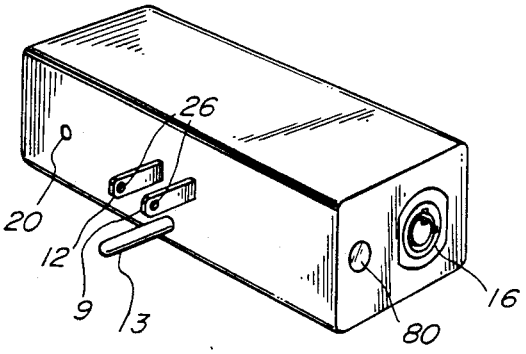
FIG. 9 is a front perspective of the second embodiment.
Figure 10:
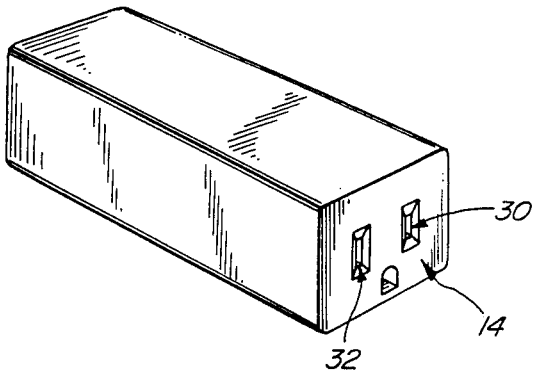
FIG. 10 is a rear perspective of the second embodiment.
Figure 11:
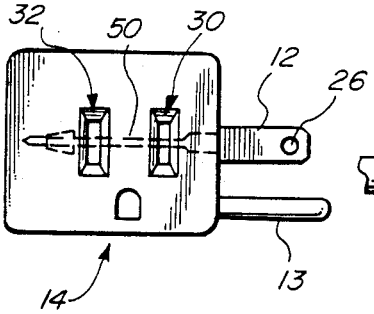
FIG. 11 is an end elevation of the second embodiment.

As shown in FIG. 9, the second embodiment contains locking pin hole 20, key operated device 16, power indicator 80, power prongs 12 and ground prong 13. FIG. 10 illustrates electrical receptacle 14 which is sized to receive a standard U.L. approved power prong configuration. As shown in FIG. 11, the locking pin 50 [shown in phantom] passes through power receptacles 30, 32.

Figure 12:
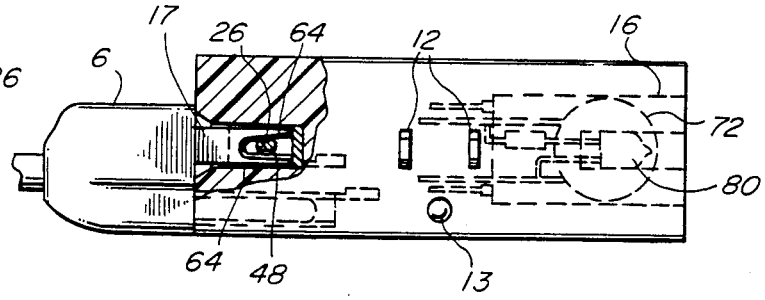
FIG. 12 is a cut-away front elevation of the second embodiment.

Referring to FIG. 12, a standard appliance plug 6 is inserted into receptacle 14 and secured by locking pin 50. The locking pin shaft 48 is shown in standard U.L. approved power prong hole 26. Shown in phantom in FIG. 12 is the power indicator 80, the surge protector 72 and the key operated device 16.

Figure 13:
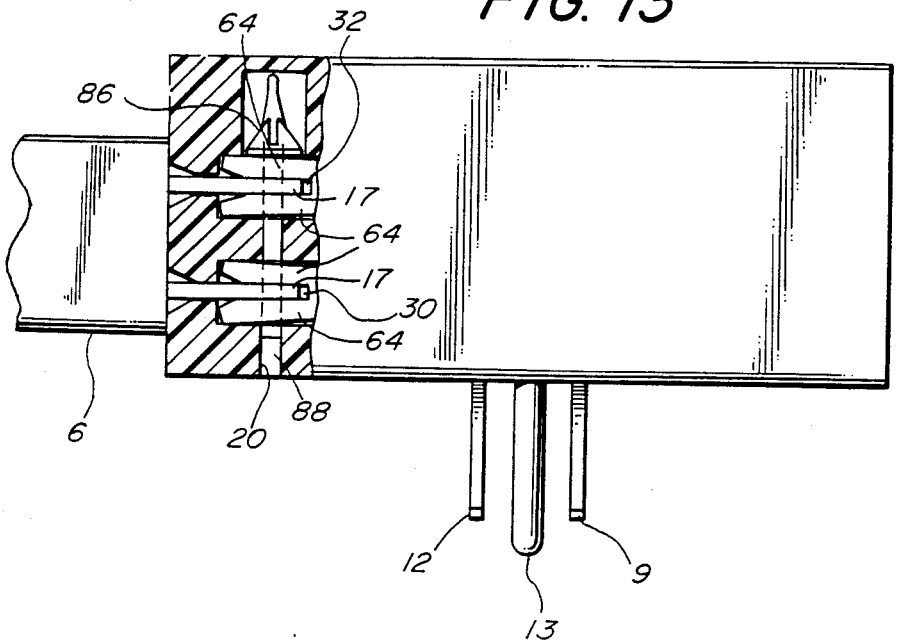
FIG. 13 is a cut-away top plan of the second embodiment.

Referring to FIG. 12, it will be noted that this second embodiment employs receptacle clips 64 to electrically contact the appliance power prongs 17. As seen in FIG. 12, the receptacle clips 64 are of a U-shaped configuration. As shown in FIG. 13, the receptacle clips 64 are positioned so as to slidably receive the appliance power prong 17.

Referring to FIG. 12, the receptacle clips 64 are positioned with respect to the power prong holes 26, so as to receive the locking pin 86 or 96 (shown in FIG. 16 and described in more detail below) within the arcuate portion of the receptacle clip 64.

Referring to FIG. 13, as the appliance plug 6 is received into the receptacle 14, the power receptacles 30, 32 receive the appliance power prongs 17 and the power prongs 17 of the appliance plug 6 are in electrical communication with the receptacle clips 64. The barbed locking pin 88 passes through the casing hole 20, the receptacle clip 64, the appliance plug hole 26, the receptacle clip 64, the inner casing of housing 10, the receptacle clip 64, the appliance prong hole 26, the receptacle clip 64 and through the barb retainer 86. As shown in FIG. 14, the barb retainer 86 is sized to receive the barbs 52. The barbs 52 pass through the barb retainer in a compressed state. Once the barbs 52 have passed through the barb retainer 86, the barbs 52 assume their unstressed configuration and seat on the barb retainer 86 as shown in FIGS. 13 and 15. This retains the pin 88 within the retainer 86 and permanently attaches the plug 6 of the electrical appliance to the invention. It should be noted that the pin 88 is retained within the arcuate or elbow portion of the receptacle clip 64. Electrical contact is achieved between the receptacle clip 64 and the appliance power prong 17. The appliance plug 6 is retained within the invention by means of the plastic locking pin 50 which passes through the appliance power prong 17 and is slidably received within hole 20. When the locking pin 50 is fixed within the hole 20, the walls of the hole 20 serve to prevent radial movement of the locking pin 50.

An alternative to the use of the barbed locking pin 88 is the straight locking pin 96, as shown in FIG. 16. The straight locking pin 96 having its securing means on its proximal end is distinct from the barbed locking pin 88 which employs securing means on the distal end. Axially spaced annular retaining flanges 94 are disposed proximal to the locking pin head 51. When the straight locking pin 96 is employed, there is no need for the barb retainer 86. The straight locking pin 96 permanently secures an appliance plug 6 to the present invention by passing through the same passage as the barbed locking pin 88 would occupy, as discussed above. A compressor/relaxation of the flange 94 accomplishes the retention of the pin 88 within the torus 82, as described similarly above in connection with pin 88.

Referring to FIG. 17, the straight locking pin 96 is permanently affixed to the present invention by the engagement of the annular retaining flanges 94 in the mating annular torus 92 of the housing 10. The annular torus 94 is an integral configuration of the housing 10. The annular torus 92 may be formed in the casting process when the housing 10 is formed. As shown in FIGS. 16 and 17, the straight locking pin 96 has the advantage of a plurality of annular retaining flanges 94 which are received by a plurality of annular torus 92. In addition, pin 96 can be rotated in any angular orientation and still be securely locked within torus 92. When the straight locking pin 96 is fully engaged with the housing 10, the locking pin head 51 is flush with the surface of the casing wall 10. The lack of available purchase means on any of the locking pins 50, 88 or 96, either by means of the barbs 52 or the retaining flanges 94, function to permanently secure the locking pin within the housing 10. The permanent attachment of the locking pin within the housing 10 when passing through the appliance plug, permanently affixes the present invention to the appliance.

Referring to FIG. 18, the second embodiment incorporates a surge protector 72 which are known in the art, such as Radio Shack surge protector part no. 276-568, and power indicator 80 which are also known in the art, such as Radio Shack neon light and resistor part no 272-1100. As the key operated control 16 is placed in the on-position, current passes through the key control 16, the surge protector 72 and the power indicator 80, thereby providing power through the present invention to the affixed appliance. The power indicator 80 provides visual confirmation of the status of the circuit by illuminating a bulb or light emitting diode, or other device known in the art. The circuitry of FIG. 18 similar to the circuitry of FIG. 8 is discussed supra.

It should be noted that the second embodiment shown in FIGS. 9–18 offers a narrow profile device for receiving the plug of the appliance and, in turn, for being plugged into an electrical outlet without extending a great distance from the wall. This configuration is advantageous where the outlet is behind furniture or where space is otherwise limited.

In addition, the present invention provides a method for regulating the unauthorized use of an electrical appliance. Initially, the present invention receives an appliance 6, thereby providing electrical communication between the present invention and the device to be regulated. The standard holes 26 of the appliance plug 6 coaxially align with hole 20 in the present invention. Further, a pin 50 is inserted through the hole 20 and hole 26 of the appliance plug 6. The pin 50 is then retained within the hole 20. The pin 50 in its retained position has no longitudinal surfaces exposed to outside of the present invention. The locking pin head 51 is flush with the outer surface of the present invention. Finally, the method provides for the activation of a switching means 16 to selectively permit the flow of electrical power to the attached appliance.

Although the present invention has been described in terms of particular embodiments, it is not limited to these embodiments. Alternative embodiments and modifications which would still be encompassed by the invention may be made by those skilled in the art, particularly in light of the foregoing teachings. Alternative embodiments, modifications, or equivalents may be included within the spirit and scope of the invention, as defined by the claims.

What is claimed is:

1. A device for preventing the unauthorized use of an electrical appliance, said electrical appliance having an electrical plug with the standard prongs extending therefrom, said prongs having standard-sized holes located near the distal end thereof, said device comprising:

a housing;

a standard electrical receptacle located in said housing for receiving said plug of said electrical appliance;

a standard electrical plug located in said housing for making electrical contact with a standard electrical outlet;

means in said housing for permanently attaching said housing to said plug to said electrical appliance such that said standard electrical plug of said housing effectively becomes the plug of said electrical appliance;

a circuit for electrically connecting said receptacle of said housing to said plug of said housing, whereby electrical current from a standard electrical outlet is conducted to said appliance through said device; and a switch to selectively (i) close said circuit to permit said current to be conducted to said appliance, and (ii) open said circuit to interrupt the flow of current to said appliance, there by controlling the unauthorized or authorized use of said appliance;

said attaching means comprising means for engaging said standard-sized holes in said prongs of the plug of said electrical appliance, thereby permanently retaining said plug in said device, wherein said engaging means comprises a pin passing through a portion of said housing and through said holes in said plug of said electrical appliance.

2. The device of claim 1, wherein one portion of said pin is deformable to permit it to pass through said holes, said portion then being restored to its previous configuration to retain said pin in position.

3. The device of claim 1, wherein said housing is comprised of a hole to receive said pin, said hole being counter-sunk such that the proximal end of said pin lies substantially flush with the outer surface of said housing.

4. The device of claim 1, wherein said pin is made of non-conductive material.

5. The device of claim 1, wherein said pin is a single, non-integral part of said electrical receptacle.

6. The device of claim 1, wherein said switch can be locked in either the closed or opened position.

7. The device of claim 6, wherein said switch is key-activated.

8. A device for preventing the unauthorized use of an electrical appliance, said electrical appliance having an electrical plug with the standard prongs extending therefrom, said prongs having standard-sized holes located near the distal end thereof, said device comprising:

a housing;

a standard electrical receptacle located in said housing for receiving said plug of said electrical appliance;

a standard electrical plug located in said housing for making electrical contact with a standard electrical outlet;

means in said housing for permanently attaching said housing to said plug of said electrical appliance such that said standard electrical plug of said housing effectively becomes the plug of said electrical appliance;

a circuit for electrically connecting said receptacle of said housing to said plug of said housing, whereby electrical current from a standard electrical outlet is conducted to said appliance through said device; and a switch to selectively (i) close said circuit to permit said current to be conducted to said appliance, and (ii) open said circuit to interrupt the flow of current to said appliance, thereby controlling the unauthorized or authorized use of said appliance;

said attaching means comprising means for engaging said standard-sized holes in said prongs of the plug of said electrical appliance, thereby permanently retaining said plug in said device, wherein one portion of said engaging means is deformable to engage and be retained in a portion of said housing.

9. The device of claim 8, further comprising a retaining clip for receiving said deformable portion of said pin.

10. A device for preventing the unauthorized use of an electrical appliance, said electrical appliance having an electrical plug with the standard prongs extending therefrom, said prongs having standard-sized holes located near the distal end thereof, said device comprising:

a housing;

a standard electrical receptacle located in said housing for receiving said plug of said electrical appliance;

a standard electrical plug located in said housing for making electrical contact with a standard electrical outlet;

means in said housing for permanently attaching said housing to said plug of said electrical appliance such that said standard electrical plug of said housing effectively becomes a plug of said electrical appliance;

a circuit for electrically connecting said receptacle of said housing to said plug of said housing, whereby electrical current from a standard electrical outlet is conducted to said appliance through said device, wherein said circuit further comprises a surge protection circuit in electrical communication between said standard electrical receptacle in said housing and said standard electrical plug in said housing; and a switch to selectively (i) close said circuit to permit said current to be conducted to said appliance, and (ii) open said circuit to interrupt the flow of current to said appliance, thereby controlling the unauthorized or authorized use of said appliance;

11. A device for preventing the unauthorized use of an electrical appliance, said electrical appliance having an electrical plug with the standard prongs extending therefrom, said prongs having standard-sized holes located near the distal end thereof, said device comprising:

a housing;

a standard electrical receptacle located in said housing for receiving said plug of said electrical appliance;

a standard electrical plug located in said housing for making electrical contact with a standard electrical outlet;

means in said housing for permanently attaching said housing to said plug of said electrical appliance such that said standard electrical plug of said housing effectively becomes the plug of said electrical appliance;

a circuit for electrically connecting said receptacle of said housing to said plug of said housing, whereby electrical current from a standard electrical outlet is conducted to said appliance through said device, wherein said circuit further comprises a power indicator; and a switch to selectively (i) close said circuit to permit said current to be conducted to said appliance, and (ii) open said circuit to interrupt the flow of current to said appliance, thereby controlling the unauthorized or authorized use of said appliance;

12. A method for regulating the unauthorized use of an electrical appliance, comprising the steps of:

a. making electrical contact between the plug of the appliance and the receptacle of a regulating device;

b. aligning the standard-sized holes in the prongs of the plug of the electrical appliance with a hole formed in the housing of the regulating device;

c. inserting a pin through the aligned hole in the housing and through the holes in the standard electrical prong;

d. retaining said pin within said aligned holes;

e. inserting said pin sufficiently into said hole so that no portion of the proximal end thereof can be gripped, thereby preventing the removal of said pin; and f. activating a switch to prevent or permit the use of the electrical appliance.

* * * * *

UNITED STATES PATENT AND TRADEMARK OFFICE
CERTIFICATE OF CORRECTION

PATENT NO. : 4,969,833

DATED : November 13, 1990

INVENTOR(S) : Lindow et al.

It is certified that error appears in the above-identified patent and that said Letters Patent is hereby corrected as shown below:

Column 4, Line 11, after "plug configuration", --11.--should be inserted.

Column 4, Line 33, after "switch housing", --18-- should be inserted instead of 1B.

Column 6, Line 13, after "of the", --15-- should be deleted.

Column 7, Line 53, after "torus", --92-- should be inserted instead of 94.

Column 8, claim 1, line 65, "plug to said", should be --plug of said--

Signed and Sealed this

Thirtieth Day of March, 1993

*Attest:*

STEPHEN G. KUNIN

*Attesting Officer*

*Acting Commissioner of Patents and Trademarks*